US008042338B2

(12) United States Patent
Russo

(10) Patent No.: US 8,042,338 B2
(45) Date of Patent: Oct. 25, 2011

(54) ATMOSPHERIC TEMPERATURE DIFFERENCE POWER GENERATOR

(76) Inventor: Anthony Russo, Albuquerque, NM (US)

( * ) Notice: Subject to any disclaimer, the term of this patent is extended or adjusted under 35 U.S.C. 154(b) by 514 days.

(21) Appl. No.: 12/285,030

(22) Filed: Sep. 29, 2008

(65) Prior Publication Data

US 2010/0077750 A1 Apr. 1, 2010

(51) Int. Cl.
*F03G 7/00* (2006.01)
*F01K 7/00* (2006.01)

(52) U.S. Cl. ..... 60/641.2; 60/641.6; 60/641.8; 60/675

(58) Field of Classification Search ..... 60/641.1, 60/675, 641.2, 641.6, 641.8
See application file for complete search history.

(56) References Cited

U.S. PATENT DOCUMENTS 3,414,481 A * 12/1968 Kelly, Jr ..... 202/234
3,919,852 A * 11/1975 Jones ..... 62/7
3,953,971 A 5/1976 Parka
3,995,428 A * 12/1976 Roberts ..... 60/641.2
4,244,189 A * 1/1981 Bliamptis ..... 60/641.11
4,318,275 A 3/1982 Brown
4,441,321 A * 4/1984 Ridgway ..... 60/641.7
5,488,828 A 2/1996 Brossard
5,582,691 A 12/1996 Flunn
6,202,417 B1 * 3/2001 Beck ..... 60/641.7
6,422,016 B2 * 7/2002 Alkhamis ..... 60/641.1
6,931,887 B2 8/2005 Ogata
7,143,602 B2 12/2006 Ogata
7,367,202 B2 5/2008 Yamada
2007/0101760 A1 5/2007 Bergander

OTHER PUBLICATIONS

Russo, Anthony J, An Investigation of Atmospheric Temperature Differential Power Generation, Sandia National Laboratory Research Report SAND74-0259, Oct. 1974.

* cited by examiner

*Primary Examiner* — Hoang Nguyen

(57) ABSTRACT

This invention consists of a process for utilizing the atmospheric temperature variation with height to produce useful energy. It is accomplished by the use of a lighter than air condensable fluid or mixture of fluids circulating between heat exchangers at different altitudes, with a two phase flow return.

12 Claims, 2 Drawing Sheets

ATMOSPHERIC TEMPERATURE DIFFERENCE POWER GENERATOR

CROSS REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The need for renewable energy sources is obvious and much effort has been directed to development of solar and wind technologies. One area of renewable energy conversion that has been relatively neglected is the use of the natural temperature variation with altitude or "lapse rate" as an energy source. The use of other naturally occurring temperature gradients such as ocean thermal energy conversion (see U.S. Pat. No. 5,582,691) have been proposed but the hostile, corrosive environment of the ocean, combined with the inherent low efficiency of small temperature differences, and the fact that the ocean thermal gradients are negative (temperature decreases with depth requiring pumps to move the water) have thus far made them impractical.

The use of the atmosphere as a thermal heat sink or source combined with external heat sources or sinks has also been considered and is practical when such external sources or (less commonly) sinks are available (see U.S. Pat. No. 5,488,828) and often require man made towers to access gravitational potential as a mechanical force agent in energy conversion.

Unlike these systems the present invention needs no external sources or sinks other than the atmosphere, and uses natural elevation changes available in mountains to both access the needed temperature difference and gravitational force to produce pressures that can be used to operate conversion machinery Such a method of using mountain access to the atmospheric gradient and a process for extracting its energy was invented and investigated by this author at Sandia National Laboratories, operating under government contract in 1973. An analysis of that system is contained in an internal Sandia report SAND 74-0259. The results of that analysis indicated that such a system was feasible to build and, for elevation changes greater than 5000 feet, could be competitive with power plant costs at that time, with most of the cost for large systems expended on heat exchangers. The invention of that system was not patented and the analysis results were not published outside the Laboratories. Since that time the Department of Energy has waived its rights to that invention to this author, but several others have already patented similar ideas. (U.S. Pat. Nos. 3,953,971 and 4,318,275). A schematic of that original process is shown in FIG. 1. A condensable lighter-than-air vapor is vaporized in the lower heat exchanger, 1, and flows up a pipe, 2, to a condenser, 3.

Although the gas cools as it rises, it does not cool as much as the atmospheric lapse rate so that a condenser in the higher cool air region will cause the vapor to condense. The denser condensed liquid then flow down another pipe, 4, and the increased pressure is used to operate some form of machinery, 5 (hydraulic pistons or turbines for example) which may be coupled to an electric generator.

Although the system shown in FIG. 1 should work (it has been modeled but not built) it presents several practical difficulties which can be overcome. First the liquid head at the bottom of the down flow pipe would be very high for the large mountains for which this system is applicable. Hydro-turbines for those high pressures do not exist and some kind of hydraulic engine would have to be developed. Second, such high pressures in a toxic liquid present additional safety concerns, and there are very few choices of lighter than air gases that are condensable at atmospheric temperatures, with ammonia being the best candidate. Third, except for the small amount of condensate carried up by the expanding vapor, all the condensate must be produced by transfer of the whole vaporization energy to the outside air through a small temperature difference, which means the heat exchangers must be very large. These problems can be overcome or mitigated by the configuration shown in FIG. 2, which is the preferred embodiment of this invention.

BRIEF SUMMARY FOR THE INVENTION

One method of utilizing the atmospheric energy source is to place a reservoir of a lighter than air, condensable gas, such as ammonia, near the base of a mountain and run a thermally insulated pipe containing this vapor to a condenser at the top of the mountain. Because the adiabatic lapse rate of such a gas is less than that of the environmental atmospheric lapse rate, the temperature of the gas at the top of the pipe will be greater than that of the air surrounding the condenser and the vapor will condense to its liquid phase. The increased gravitational potential of the liquid and vapor can then be converted to useful work as it falls back to the lower reservoir (vaporizer). If that work is used to accelerate and pressurize the uncondensed vapor before it falls back down to the vaporizer the disadvantages of the previous system of FIG. 1 can be overcome or mitigated.

Therefore, the present invention is directed to an apparatus and process for utilizing the atmospheric temperature variation to generate useful energy by means of a lighter-than-air, condensable working fluid or partially condensable gas mixture which can transfer heat from a vaporizer at a lower elevation to a heat exchanger (i.e., condenser) at a higher elevation and convert the potential energy of a two phase down-flow (liquid and vapor) to work, in gas and/or liquid driven machines. A nozzle, preferably a condensing ejector nozzle, in a down-flow pipe can convert part or all of the potential energy of the raised liquid to re-pressurize the vapor or gas at or from the high altitude heat exchanger before it is returned to the conversion machinery or the lower vaporizer. Solar, wind, or geothermal means can be used in conjunction with the atmospheric temperature differential generation process to enhance the heat delivered to the lower vaporizer or its working fluid or removed at the upper heat exchanger condenser. A liquid-vapor-separator and/or super-heater can be used to separate and/or superheat the vapor flowing to the energy conversion machinery used to generate power.

The advantages of using such an atmospheric temperature difference power system are:

1. Freedom from fuel costs and air pollution problems; It is the only energy conversion system that reduces global warming by heat transfer to the upper atmosphere where it can be radiated into space;
2. the average lapse rate is fairly constant and though there are local variations, most of them would not prevent the system from operating so that, unlike wind or solar, nearly continuous operation is possible;

3. the system is natural hybrid one with wind, solar and geothermal. That is, when the wind blows the system output increases, and when the sun shines on the vaporizer it does too. It may be the best use of wind power because it utilizes both the kinetic energy and thermal transport properties of the wind. It can also easily be synergized with other types of low grade energy sources such as geothermal or waste heat from existing power plants.

DETAILED DESCRIPTION OF THE INVENTION

Figure 1:
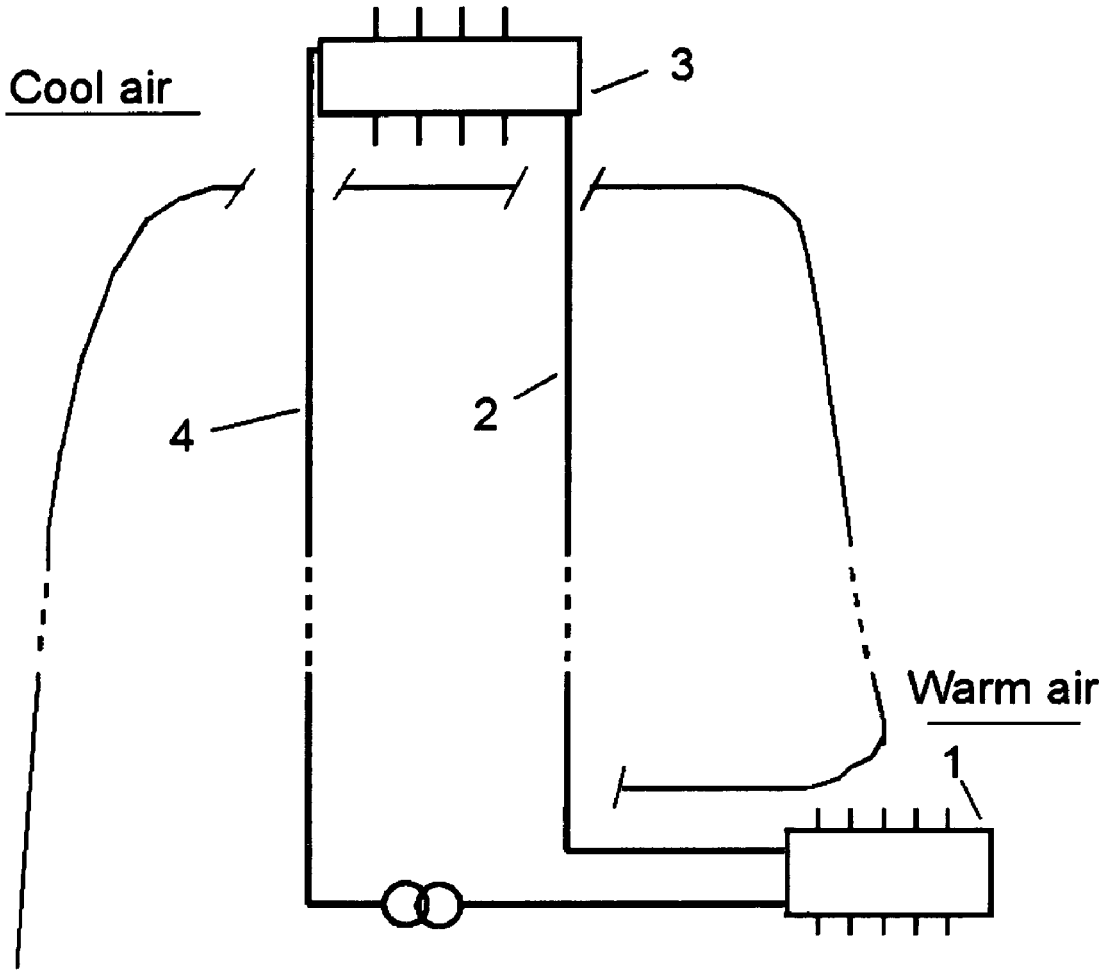
FIG. 1. A flow diagram of an atmospheric temperature differential Power generator system with liquid down-flow. The simplest configuration of the prior art.
Figure 2:
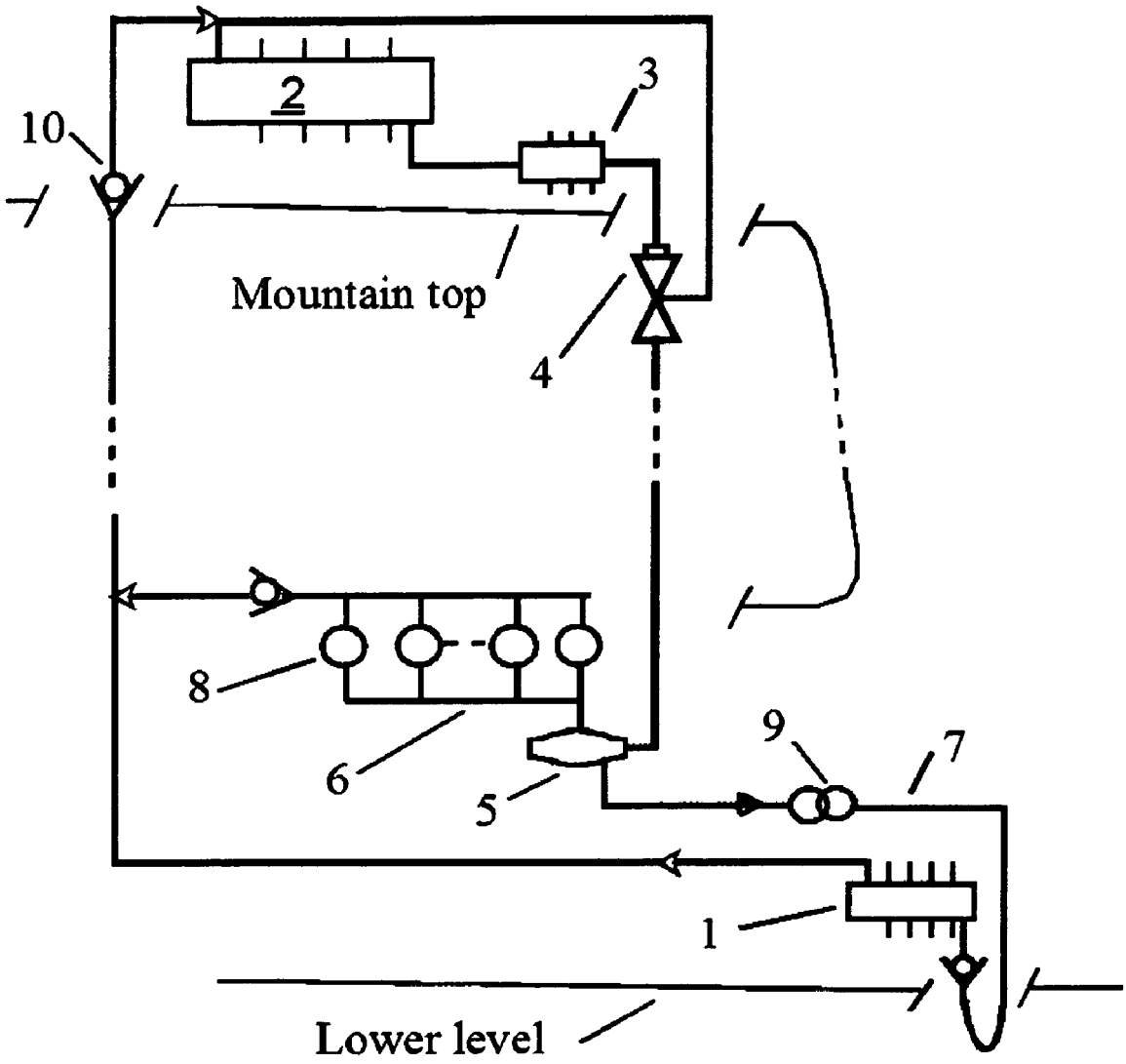
FIG. 2. A flow diagram of an atmospheric temperature differential Power generator with two phase down-flow. The preferred embodiment.

A schematic flow diagram of the preferred embodiment of the invention is shown in FIG. 2. As in the process described in FIG. 1, the vaporizer, 1, contains a lighter than air condensable (or partially condensable mixture) fluid which pumps itself up through an insulated pipe and a check valve, 10, to a condenser, 2, at the mountain top due to the atmospheric temperature difference. For example if the atmospheric temperature surrounding the vaporizer is 75 degrees F., and the fluid in the vaporizer is slightly cooler, due to vaporization, at 70 F, its vapor pressure would be 128.8 psia. The average temperature of the atmosphere at an elevation 5000 feet higher than the vaporizer would be 55 degrees F., and if the condenser temperature were slightly higher, at 60 F, the vapor pressure of ammonia in the condenser would be 107.6 psia. The difference in pressures would cause the vapor to rise and if the rise were isentropic the temperature and pressure of the rising vapor at the condenser entrance would be 63.7 F, and 114.5 psia respectively. The difference of (114.5−107.6)=6.9 psi is what drives the vapor upward and is expended in pipe friction.

The use of check valves prevents backflow and helps in damping transients, so these may be inserted, subtracted and located as needed. A non-condensable, lighter than air gas, such as helium, may be mixed with a condensable working fluid to lower the average density of the vapor mixture. This opens the possibility of the use of more working fluids and could improve the operation with fluids such as ammonia.

Instead of the condensate being returned directly to the vaporizer, as it is in FIG. 1, it is sent through a sub-cooler 3 or extension of the condenser 2, to a control valve and an ejector nozzle, 4, which draws vapor from the condenser and/or its inlet and raises its pressure in the nozzle diffuser section. The nozzle is located far enough below the condenser so that the liquid head of the condensed fluid is sufficient to operate the ejector with no additional pumps. Cooling the liquid before mixing it with vapor in the ejector increases both the pressure and density of the exiting flow. A condensing ejector nozzle is preferable since it allows additional condensation to take place without requiring external heat flow. Such a nozzle makes use of the fact that the speed of sound in a two-phase flow is much lower than that of a pure vapor.

The vapor is accelerated to subsonic velocity in the vapor phase which then transitions to a supersonic level in the mixing section and a shock causes the pressure to rise higher than its original stagnation pressure in such a device (descriptions of such nozzles used in refrigeration systems are given in U.S. Pat. Nos. 7,367,202, 7,143,602, 6,931,887 and Application 2,0070101760). Additional pressure rise then occurs as the two-phase flow moves down a vertical pipe to a liquid-gas-separator, 5, and additional condensation due to the pressure rise in the presence of a liquid spray takes place further increasing the density and pressure of the flow. The amount of pressure rise can be controlled by controlling the ratio of liquid spray to gas flow at the nozzle. The use of a condensing ejector is preferable because in the condensing shock additional condensate is generated near the top of the down flow pipe increasing the pressure without additional heat transfer in the heat exchangers for a given power output, thereby reducing their size.

The separated liquid, which is at a higher pressure than the vaporizer, may then be returned 7 to the vaporizer through a hydraulic engine-generator, 9, and a check valve producing additional power. Since the ground temperature increases with depth, the liquid may optionally at this point be directed through a geothermal ground loop to the vaporizer and any heat absorbed by the liquid as it traverses the loop will also be utilized by the system.

The pressure enhanced vapor goes to a vapor line, 6, and is used to drive the main power producing engines, 8, which may consist of one or more mechanical and electrical machines, and then returned to the vapor up-flow line where it is mixed with vapor flowing up from the vaporizer, and the cycle is complete. If required by the engines (some turbines) the vapor may be actively (by external heat sources), or passively, superheated at the liquid-gas-separator, 5. Passive superheating takes place when part of the pressure of a saturated vapor is used to accelerate the vapor, and the condensate produced is removed. Then the vapor is reversibly decelerated. For example this can be done by injecting the saturated flow into a vertical cylinder tangentially at the outer edge and removing it at an orifice at the upper axis. As the fluid accelerates toward the axis it cools and some condensate is formed which is centrifuged to the walls and falls to the bottom of the cylinder where it is removed at a liquid exit orifice. The vapor is decelerated in a diffuser section, which raises the temperature and partially recovers the pressure. The resulting vapor is superheated but at a lower pressure than the original saturated stagnation pressure.

The present invention may be embodied in other forms without changing its essential attributes therefore reference should be made to the appended claims rather than to the given specification to indicate the scope of the invention.

I claim:

1. An atmospheric temperature difference power generator, comprising:

a vaporizer at low elevation for vaporizing a lighter-than-air condensable working fluid, an insulated up-flow pipe for rising the vaporized working fluid up from the vaporizer through an elevation rise, wherein the atmospheric temperature decreases with elevation, a condenser for partially condensing the vaporized working fluid from the up-flow pipe due to heat exchange with the lower temperature atmosphere at the higher elevation to provide a condensate and a vapor, a nozzle below the condenser having a throat and a diffuser section for expanding the vapor from the condenser and the up-flow pipe through the throat and mixing the expanded vapor with the condensate from the condenser, thereby further compressing the mixture in the diffuser section to provide a compressed two-phase mixture, an insulated down-flow pipe for dropping the compressed two-phase mixture down from the condensing ejector nozzle through an elevation drop, thereby further compressing the two-phase mixture by gravitational compression to a higher pressure than the working fluid in the vaporizer, a separator for separating the liquid from the vapor in the further compressed two-phase mixture from the down-flow pipe, and a power engine for generating power from the separated vapor and a hydraulic engine for generating power from the separated liquid.

2. The atmospheric temperature difference power generator of claim 1, wherein the nozzle comprises a condensing ejector nozzle.

3. The atmospheric temperature difference power generator of claim 1, further comprising a geothermal ground loop for heating the liquid from the hydraulic engine prior to returning the liquid to the vaporizer.

4. The atmospheric temperature difference power generator of claim 1, further comprising a sub-cooler after the condenser to further cool the condensate before mixing the further cooled liquid with the expanded vapor in the nozzle.

5. The atmospheric temperature difference power generator of claim 1, further comprising a check valve in the up-flow pipe to prevent backflow and help in damping transients.

6. The atmospheric temperature difference power generator of claim 1, further comprising an external heat source for superheating the separated vapor prior to the power engine.

7. The atmospheric temperature difference power generator of claim 1, further comprising means for passively superheating the separated vapor prior to the power engine.

8. The atmospheric temperature difference power generator of claim 1, wherein the working fluid comprises ammonia.

9. The atmospheric temperature difference power generator of claim 1, wherein the working fluid further comprises a non-condensable gas.

10. The atmospheric temperature difference power generator of claim 9, wherein the non-condensable gas comprises helium.

11. The atmospheric temperature difference power generator of claim 1, wherein the means for the elevation rise is a mountain.

12. A process for generating power using the atmospheric temperature difference, comprising:

vaporizing a lighter-than-air condensable working fluid at a low elevation, rising the vaporized working fluid up through an elevation rise in an insulated up-flow pipe, wherein the atmospheric temperature decreases with elevation, partially condensing the working fluid due to heat exchange with the lower temperature atmosphere at the higher elevation to provide a condensate and a vapor, expanding the vapor through a nozzle and mixing the expanded vapor with the condensate in the nozzle to provide a compressed two-phase mixture, dropping the compressed two-phase mixture down from the nozzle through an elevation drop in an insulated down-flow pipe, thereby further compressing the two-phase mixture by gravitational compression to a higher pressure than the working fluid at the low elevation, separating the liquid from the vapor in the further compressed two-phase mixture, and generating power from the separated vapor and from the separated liquid.

* * * * *